United States Patent [19]

Poddar

[11] 4,304,655

[45] Dec. 8, 1981

[54] LIQUEFACTION PROCESS

[75] Inventor: Syamal K. Poddar, Baytown, Tex.

[73] Assignee: Exxon Research & Engineering Co., Florham Park, N.J.

[21] Appl. No.: 101,924

[22] Filed: Dec. 10, 1979

[51] Int. Cl.[3] ..... C10G 1/00; C10G 1/06

[52] U.S. Cl. ..... 208/8 LE

[58] Field of Search ..... 208/8 LE, 8 R

[56] References Cited

U.S. PATENT DOCUMENTS

| | | | |
|---|---|---|---|
| T700,485 | 4/1969 | Hemminger et al. | 208/8 LE |
| 1,436,289 | 11/1922 | Plauson | 208/8 LE |
| 1,840,287 | 1/1932 | Hofmann et al. | 208/8 LE X |
| 2,133,280 | 10/1938 | Burk | 208/8 LE |
| 2,191,156 | 2/1940 | Pier et al. | 208/10 |
| 2,221,410 | 11/1940 | Pier | 208/8 LE |
| 4,120,664 | 10/1978 | Gleim | 208/8 LE |
| 4,161,440 | 7/1979 | Brunson | 208/8 R |

OTHER PUBLICATIONS

Pauling, *College Chemistry*, (1951), Pub. by W. H. Freeman and Co., San Francisco, Calif., pp. 364–366.

*Primary Examiner*—Delbert E. Gantz
*Assistant Examiner*—O. Chaudhuri
*Attorney, Agent, or Firm*—Wayne Hoover

[57] ABSTRACT

Scale formation during the liquefaction of lower ranking coals and similar carbonaceous materials is significantly reduced and/or prevented by pretreatment with a combination of pretreating agents comprising $SO_2$ and an oxidizing agent. It is essential to effective operation that the moisture content of the solid carbonaceous material be within the range from about 10 to about 25 wt %, based on dry solid carbonaceous material, during the pretreatment. The pretreatment is believed to convert at least a portion of the scale-forming components and particularly calcium, to the corresponding sulfate prior to liquefaction. The pretreatment may be accomplished with the combination of pretreating agents either simultaneously by using a mixture comprising $SO_2$ and a gaseous oxidizing agent or sequentially by first treating with $SO_2$ and then with an oxidizing agent.

13 Claims, 2 Drawing Figures

LIQUEFACTION PROCESS

The Government of the United States of America has rights in this invention pursuant to Contract No. EF-77-A-01-2893 awarded by the U.S. Department of Energy.

BACKGROUND OF THE INVENTION

1. Field of the Invention

This invention relates to an improved process for converting coal or similar solid carbonaceous material containing certain mineral matter. More particularly, this invention relates to an improved process for liquefying coal and similar carbonaceous materials.

2. Description of the Prior Art

As is well known, coal has long been used as a fuel in many areas. For several reasons, such as handling problems, waste disposal problems, pollution problems and the like, coal has not been a particularly desirable fuel from the ultimate consumers point of view. Moreover, coal cannot be used directly as a fue, in many areas, especially in areas where a liquid fuel is required such as in the operation of automobiles, trucks and the like. As a result, oil and gas have enjoyed a dominant position, from the standpoint of fuel sources, throughout the world.

As is also well known, proven petroleum and gas reserves are shrinking throughout the world and the need for alternate sources of energy is becoming more and more apparent. One such alternate source is, of course, coal since coal is an abundant fossil fuel in many countries throughout the world. Before coal will be widely accepted as a fuel, however, it is believed necessary to convert the same to a form which will not suffer from the several disadvantages alluded to previously and which will permit use in those areas where a liquid fuel is normally required.

To this end, several processes wherein coal is liquefied have been proposed heretofore. Of these, the processes wherein coal is liquefied at an elevated temperature and pressure in the presence of a suitable solvent or diluent and molecular hydrogen appear to offer the greater advantages. Difficulty has, however, been encountered during the liquefaction of certain coals, particularly the lower ranking coals, apparently as the result of extraneous mineral matter contained in these coals.

While the inventor here does not wish to be bound by any particular theory, it is believed that the operating difficulties are associated with the presence of one or more alkaline earth metals, particularly calcium, and to some extent the presence of iron, which react during liquefaction with available anions to form a solid scale or deposit. As liquefaction continues the amount of scale increases in the liquefaction reactor thereby reducing reactor volume and, hence, the liquefaction contacting time and/or the total throughput. Ultimately, complete plugging may occur. Moreover, it is possible that portions of the scale or deposits can dislodge from the walls and result in downstream plugging.

The scaling and/or deposit problem is believed to have been first reported upon in the literature in connection with the operation of a high pressure coal liquefaction plant for producing liquids from lignites at Wesseling, near Cologne, Germany. According to the literature, operation of this plant was severely limited by a solid referred to as "caviar", the reference apparently stemming from the appearance of the solid in the form of agglomerated balls or spherulites. According to the literature, the spherulites were found to comprise calcium carbonate and hexagonal crystals of iron sulfide.

Early attempts to solve the problem involved the use of what might be termed engineering techniques which were designed either to prevent scale formation or to remove the scale before operating problems were encountered. In one such technique, a small slipstream was withdrawn from an initial reactor of a series in a process. With this technique, the initially formed particles were continuously withdrawn and removed and the slipstream then returned to the reactor. This technique aided in suppressing further crystal growth and slowed down the rate of scale formation within the reactor. The technique did, however, result in high gas losses and erosion rates within auxiliary equipment.

More recently, it has been discovered that calcium carbonate deposits which form during liquefaction as the result of the decomposition of various calcium organic compounds can be avoided by converting the calcium organic compounds which do decompose during liquefaction to a salt which will remain stable during liquefaction or to a form which can be removed prior to liquefaction. Conversions of this type can be effected with a relatively broad range of pretreating agents including salts of metals different from calcium which will, effectively, replace the calcium in the coal, various organic and inorganic acids and certain gaseous pretreating agents such as $SO_2$ and $SO_3$.

For the most part, these ion exchange-type pretreatments have been quite effective in solving the scale or deposition problem. Most such treatments, however, involve the use of aqueous solutions of pretreating agents thereby increasing the amount of water which must be removed either prior to or during liquefaction. This difficulty can be avoided by the use of a gaseous pretreating agent, but when the more available and less costly $SO_2$ is used, extended contacting times are required to produce a salt which remains stable during a subsequent liquefaction operation. The extended time is, apparently, required to permit an "in situ" oxidation to occur. The use of an oxidizing agent in combination with $SO_2$ has reduced the time required to effect the desired conversion but when coal containing excessive moisture is pretreated, agglomeration of the coal particles has hampered successful operation. The need, therefore, for an improved method of avoiding the scale and/or solid deposition problem when $SO_2$ is used as a pretreating agent in a fluid bed treating operation is believed to be readily apparent.

SUMMARY OF THE INVENTION

It has now, surprisingly, been discovered that the foregoing disadvantages of the prior art $SO_2$ pretreatment methods can be overcome with the method of the present invention and a method for more effectively liquefying lower ranking coals provided thereby. It is, therefore, an object of this invention to provide an improved method for liquefying lower ranking coals and similar carbonaceous materials containing organic salts of alkaline earth metals which decompose during liquefaction to produce a scale and/or solid deposit which hampers smooth operation. It is still another object of this invention to provide such an improved process wherein the scale and/or solid deposition problem is avoided by pretreatment of the coal or similar carbonaceous material to be liquefied with a combination of gaseous pretreating agents which do not require the use of an aqueous solution. It is still another object of this invention to provide such an improved process wherein the pretreatment can be effectively accomplished without agglomeration of the solid carbonaceous material particles. These and other objects and advantages will become apparent from the description set forth hereinafter.

In accordance with this invention, the foregoing and other objects and advantages are accomplished by subjecting a lower ranking coal or similar carbonaceous material containing a controlled amount of water to a pretreatment with either a gaseous mixture of $SO_2$ and an oxidizing agent or first with gaseous $SO_2$ and then a gaseous oxidizing agent and thereafter liquefying at least a portion of the same. As indicated more fully hereinafter, and when a gaseous mixture is used, it is important that the pretreatment be accomplished with an oxidizing agent capable of providing at least 0.5 mols of $O_2$ per mol of $SO_2$ absorbed by the solid carbonaceous material and/or reacted with the mineral matter thereof during the pretreatment. As is also more fully indicated hereinafter, liquefaction of the pretreated coal or similar carbonaceous material may be accomplished in accordance with any of the techniques known in the prior art to be effective for his purpose.

DETAILED DESCRIPTION OF THE INVENTION

Figure 1:
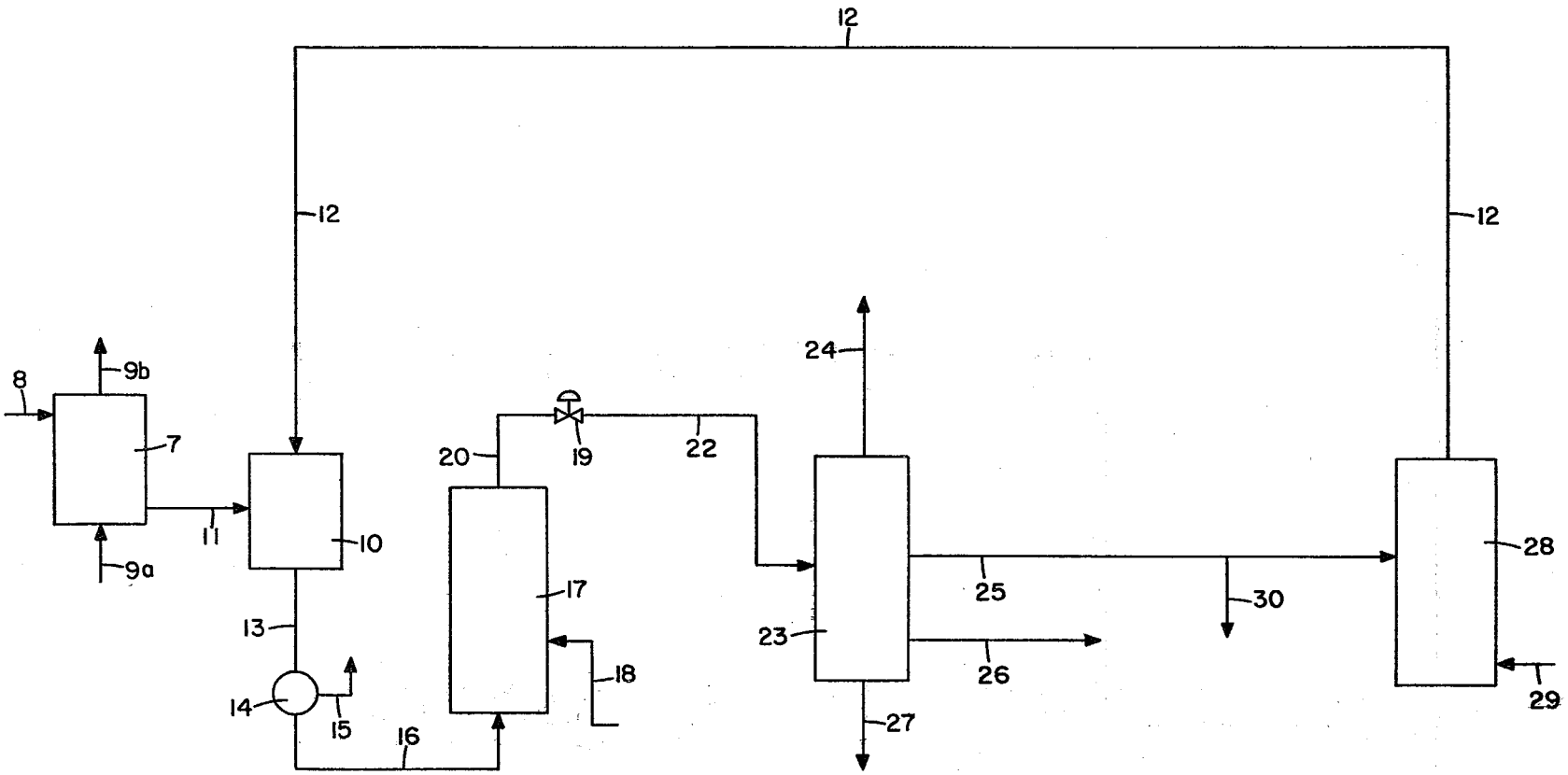
FIG. 1 is a schematic flow diagram of a process within the scope of this invention.

As indicated supra, the present invention relates to an improved process for the liquefaction of lower ranking coals and similar carbonaceous materials. The improvement comprises the pretreatment of the coal or similar carbonaceous material to either eliminate or at least significantly reduce the formation of solid deposits during liquefaction which ultimately results in scale formation and/or plugging. As also indicated supra, the scale and plugging is believed to be due to the decomposition of alkaline earth metal humates and particularly calcium humates during liquefaction and the concurrent or subsequent formation of calcium carbonate. In the present invention, the formation of the alkaline earth metal carbonate and particularly calcium carbonate during liquefaction is reduced or eliminated by forming the sulfate prior to liquefaction. As indicated more fully hereinafter, the alkaline earth metal sulfate which is formed during pretreatment will be finely divided and while it remains with the coal during liquefaction it does not agglomerate or form scale.

In general, the improved method of this invention can be used with any coal containing one or more alkaline earth metal humates and particularly any coal containing a calcium humate. Such coals include subbituminous coal, lignite, peat, brown coal and similar solid carbonaceous materials.

In general and prior to the pretreatment of this invention, the coal will be ground to a finely divided state. The particular particle size, or particle size range, actually employed will depend a great deal upon the optimum size to be used in the subsequent liquefaction conversion although the actual particle size range employed will have some effect on the rate of pretreatment and hence the rate of conversion of the alkaline earth metal humate to the corresponding alkaline earth metal sulfate. In this regard, it should be noted that in most liquefaction processes the coal to be liquefied will, generally, be ground to a particle size of less than about one-quarter inch and preferably to a particle size of less than about eight mesh NBS sieve size.

In general, the pretreatment of this invention will be accomplished by contacting a finely divided lower ranking coal with both $SO_2$ and a gaseous oxidizing agent. The contacting may be accomplished with both treatings simultaneously by using a gaseous mixture comprising $SO_2$ and an oxidizing agent, or sequentially by first contacting with $SO_2$ and then a gaseous oxidizing agent.

In general, and when the contacting is accomplished simultaneously, essentially any gaseous oxidizing agent which will provide the requisite amount of oxygen may be used. Such oxidizing agents include oxygen (air), ozone, and the like. When the contacting is accomplished sequentially, any oxidizing agent useful in the simultaneous treatment and which will provide the requisite amount of oxygen may be used. The treating gas may be dry or the same may contain any amount of moisture up to the saturation concentration of the gas at the conditions of the pretreatment. Use of a saturated gas is, however, preferred since a larger percentage of the calcium in the solid carbonaceous material will, generally, be converted to a stable form when this is done.

In general, the contacting may be accomplished either simultaneously or sequentially at essentially any total pressure. It is important, however, that the partial pressure of sulfur dioxide during the pretreatment be at least about 0.5 psi and that the partial pressure of the oxidizing agent be at least about 0.3 psi. There is, of course, no upper limit on either the total pressure during pretreatment of the $SO_2$ or $0_2$ partial pressure. Nonetheless, the pretreatment will, generally, be accomplished at a total pressure within the range from about 10 to about 50 psi; a minimum $SO_2$ partial pressure during pretreatment within the range from about 0.5 to about 40 psi and an oxidizing agent partial pressure within the range from about 0.03 to about 20 psi.

In general, the temperature at which the pretreatment is accomplished is not critical and any temperature could be employed so long as the contacting time is adjusted so as to permit the conversion of at least a substantial portion of the alkaline earth metal humate. Temperatures within the range from about 70 to about 150° F. will, however, be particularly effective when the contacting is accomplished either simultaneously or sequentially at contacting times sufficient to permit adequate contacting of both treating agents with the coal. Generally a contacting or nominal holding time of at least 5 minutes will be required when the contacting is accomplished simultaneously, and a holding time of at least 5 minutes will be required in each stage when the contacting is accomplished sequentially.

In general, the contacting between the coal and the treating agents may be accomplished in any manner known in the prior art to be effective for such contacting and the contacting may be accomplished either continuously or in a batch operation. When continuous contacting is employed, a moving bed or a fluidized bed of coal will generally be contacted with a gas stream containing sufficient sulfur dioxide to provide from about 0.01 to about 0.2 parts of $SO_2$ per part (by weight)

of coal and a sufficient amount of an oxidizing agent to provide from about 0.003 to about 0.06 parts of $O_2$ per part (by weight) of coal. Also, when a fluidized bed technique is employed, sufficient gas will be used to maintain a fluidized bed of the particulate coal. When batch treatment is employed, a fixed bed of finely divided coal may be contacted with a sufficient amount of a gaseous mixture comprising $SO_2$ to provide from about 0.03 to about 0.3 mols of $SO_2$ either simultaneously or sequentially, with from about 0.01 to about 0.2 mols of $O_2$ per kilogram of coal at a total pressure within the range from about 10 to about 50 psia. Alternatively, a fixed bed of coal may be contacted with a gas stream containing sufficient sulfur dioxide and oxygen to provide a flow rate within the range from about 0.04 W/W/hour to about 4.0 W/W/hour of $SO_2$ and from about 0.01 to about 1.5 W/W/hour of $O_2$ per unit weight of coal.

As previously indicated, it is critical that the moisture content of the solid carbonaceous material be controlled within relatively narrow limits to insure effective pretreatment in a fluidized bed. For example, when the solid carbonaceous material contains less than about 10 wt % moisture, the reaction through which the calcium is converted to a stable form does not occur readily. When the moisture exceeds about 25 wt %, on the otherhand, agglomeration of the fluidized particles occurs thereby making contact between the calcium and the $SO_2$ more difficult. Moreover, pressure drop across the fluid bed increases as a result of agglomeration and the agglomerated particles may become unfluidized. It is, therefore, essential to effective operation that the moisture content be controlled between about 10 and 25 wt % based on dry carbonaceous material. Control can be effected by drying when the carbonaceous material contains more than 25 wt % moisture and by wetting and then drying when the carbonaceous material contains less than about 10 wt % moisture.

Following the pretreatment, the coal may then be liquefied by any of the methods known in the art to be effective therefor. Such methods include processes wherein the coal is simply subjected to pyrolysis in the absence of air or oxygen, processes of the type where the coal is heated in the presence of hydrogen, and processes wherein coal is liquefied in the presence of a solvent.

In those processes where the coal is pyrolyzed either in the presence of an inert atmosphere or in the presence of hydrogen, contacting can be accomplished either in a fixed bed, a fluid bed or in a slurry. Generally, pyrolysis is effected at a temperature within the range from about 350° C. to about 800° C.

In those processes where a solvent is used, any liquid-solid contacting can be employed. In those processes wherein a carrier liquid or solvent is used, liquefaction is generally accomplished at a temperature within the range from about 350° C. to about 500° C. and the ratio of coal-to-liquid generally ranges from about 1:1 to about 1:4. The carrier liquid or solvent may or may not act as a hydrogen transferring media. In those cases where the carrier liquid and/or the solvent acts as a hydrogen donor, the carrier liquid and/or solvent will generally be withdrawn from the liquefaction vessel and hydrogenated so as to restore the desired hydrogen content. Such hydrogenation will, of course, be accomplished in accordance with techniques well known in the prior art; such as the process described in U.S. Pat. No. 3,617,513, and forms no part of the present invention.

DESCRIPTION OF THE PREFERRED EMBODIMENT

In a preferred embodiment of the present invention, a lower ranking coal such as a subbituminous coal or a lignite is ground to a finely divided state, dried or wetted such that its moisture content is within the range from about 20 to about 25 wt %, based on dry coal, and then contacted in a fluidized bed with a gaseous mixture comprising from about 5 to about 25 mols % of $SO_2$ and from about 0.25 to about 1.5 mols of $O_2$ per mol of $SO_2$. The contacting will be accomplished at a space velocity, based on sulfur dioxide, within the range from about 0.1 W/W/hour to about 8 W/W/hour. The contacting will also be accomplished at a total pressure within the range from about 15 to about 45 psi and at an $SO_2$ partial pressure within the range from about 0.4 to about 20 psi. Most preferably, the contacting will be accomplished at a temperature within the range from about 80 to about 100° F. The nominal contacting time will then range from about 10 to about 60 minutes.

When the coal is pretreated in accordance with the method of the preferred embodiment, from about 60 to about 90 percent of the alkaline earth metal humates originally present in the coal will be converted to an insoluble, thermally stable alkaline earth metal sulfate which remains within the coal and is released during liquefaction as particulate solids which are recovered with the liquefaction bottoms. The alkaline earth metal sulfate which is carried into the liquefaction stage after pretreatment remains finely divided, does not agglomerate, and does not result in scale formation and/or plugging.

Also in a preferred embodiment, after the pretreatment, the pretreated coal will be admixed with a recycle donor solvent. The total solvent and coal will, generally, be admixed in a solvent-to-coal ratio ranging from about 0.8:1 to 4:1, most preferably from about 1.2:1 to about 1.6:1, based on weight. In the preferred embodiment, the solvent will be one derived from coal and, generally, will boil within the range from about 400° to about 850° F., most preferably from about 400° to 700° F. After the coal-solvent slurry is formed, the same will, generally, be combined with molecular hydrogen and fed to a coal liquefaction zone.

Within the coal liquefaction zone, liquefaction conditions include a temperature ranging from about 700° F. to about 950° F., preferably from about 800° F. to about 850° F. with pressures ranging from about 300 psia to about 3000 psia, most preferably from about 800 psia to about 2000 psia. Preferably, molecular hydrogen will be added to the liquefaction zone at a rate from about 1 to about 6 wt % (MAF coal bases). Liquid residence times will, generally, range from about 5 to about 130 minutes and most preferably will range from about 10 to about 60 minutes.

The product from the coal liquefaction zone consists of gases and liquids, the liquids comprising a mixture of undepleted hydrogen donor solvent, depleted hydrogen donor solvent, dissolved coal, undissolved coal and mineral matter. In the preferred embodiment, the liquid mixture will be transferred to a separation zone wherein a light fraction useful as a fuel gas, a naphtha fraction, a hydrogen donor solvent fraction, a fuel oil fraction and a bottoms fraction is recovered. The bottoms fraction which, generally, will boil above about 1000° F. will include char, mineral matter and ash and may subsequently be fed to a gasification or coking process.

In the preferred embodiment, the solvent fraction will be hydrogenated before the same is recycled to the liquefaction zone. Preferably, the hydrogenation will be accomplished catalytically at conditions known in the prior art to be effective for this purpose. Normally, these include a temperature within the range from about 650° F. to about 850° F. and at a pressure within the range from about 650 psia to about 2000 psia. The hydrogen treat rate during the hydrogenation will generally be within the range from about 1000 to about 10,000 SCF/B. Any of the known hydrogenation catalysts may be employed. Following hydrogenation, the solvent may then be used to slurry additional pretreated coal.

As a result of the pretreatment, scaling and/or plugging which is normally encountered during the liquefaction of lower ranking coals is either significantly reduced or eliminated. As a result, longer periods of uninterrupted operation are possible and there is little, if any, need to reduce the throughput during these operations.

The present invention and particularly two embodiments thereof will become even more apparent from the following discussion which makes reference to the attached drawings. Referring then to FIG. 1, finely divided coal containing from about 20 to 25 wt moisture, based on dry coal, is fed to pretreatment vessel 7 through line 8. In the pretreatment vessel, the finely divided coal is fluidized and contacted with a gaseous mixture comprising $SO_2$ and $O_2$ which is introduced through line 9A and is withdrawn through line 9B. Total pressure is maintained between about 15 and about 45 psi; the $SO_2$ partial pressure is maintained between about 1 and about 15 psi; the $O_2$ partial pressure is maintained between about 0.05 to about 7.5 psi; the temperature is maintained between about 80° and about 100° F.

Figure 2:
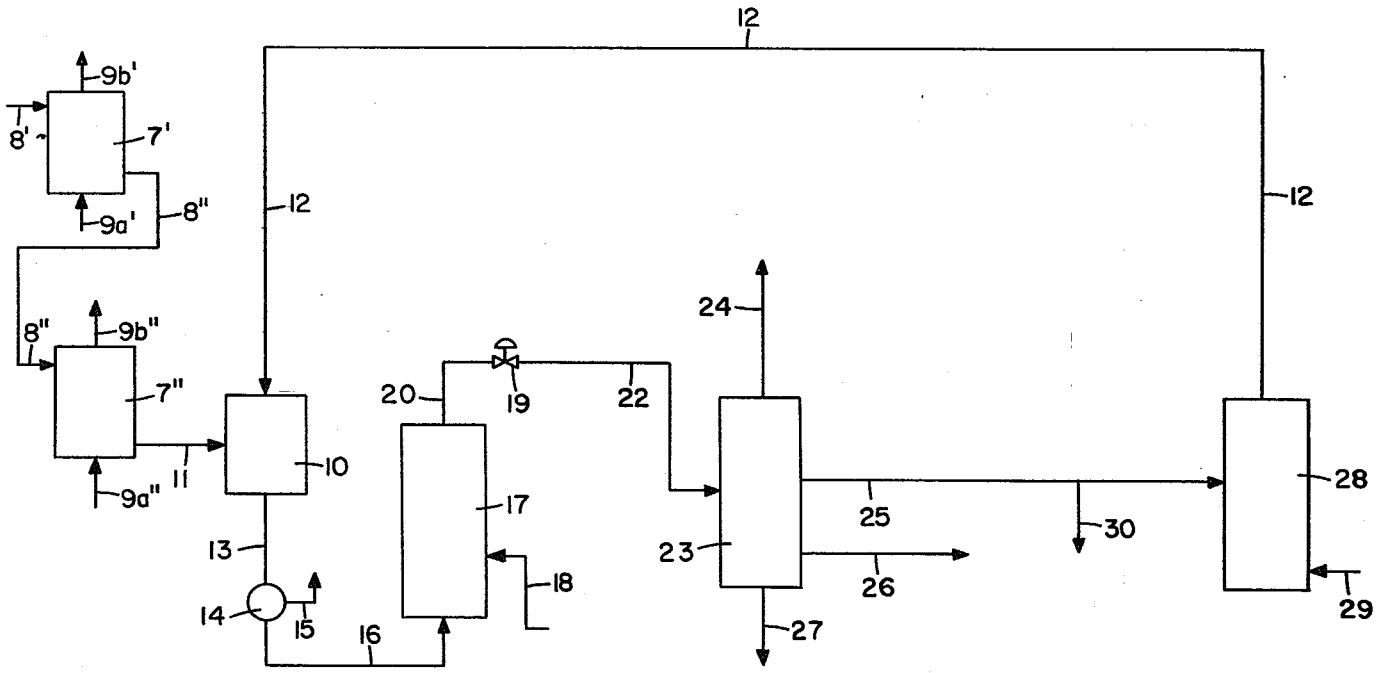
FIG. 2 is a schematic flow diagram of still another process within the scope of this invention.

Alternatively, and as illustrated in FIG. 2, the pretreatment can be accomplished in two stages. In the embodiment illustrated, finely divided coal containing from about 20 to about 25 wt % moisture, on a dry coal basis, will be fed to pretreatment vessel 7', through line 8'. In the pretreatment vessel 7', the finely divided coal will be fluidized and contacted with a gaseous mixture comprising $SO_2$ such that the total pressure and $SO_2$ partial pressures are within the ranges specified in the previous paragraph. The gaseous mixture will be introduced through line 9A' and withdrawn through line 9B'. Partially pretreated coal is withdrawn through line 8'' and transferred to a second pretreatment vessel 7''. In this second pretreatment vessel 7'', the partially pretreated coal is fluidized and contacted with a gaseous mixture comprising an oxidizing agent, preferably oxygen (air) such that the total pressure and oxygen partial pressure are within the ranges specified in the previous paragraph. The gaseous mixture comprising the oxidizing agent will be introduced through line 9A'' and withdrawn through line 9B''.

In both embodiments, and as illustrated in both figures, the treated coal is then introduced into mixing vessel 10 through line 11 and slurried with recycle solvent which is introduced through line 12. As indicated hereinafter, the recycle solvent is preferably hydrogenated prior to introduction into mixing vessel 10. The coal/solvent slurry is then withdrawwn from the mixer through line 13 and passed through heat exchanger 14. In the heat exchanger, the slurry will be heated to a temperature within the range from about 300° to about 400° F. and in the embodiment illustrated, steam will be withdrawn through line 15 so that the moisture content of the coal in the slurry will be within the range from about 1 to about 10 wt % when the slurry is withdrawn through line 16 and fed to liquefaction vessel 17. In the liquefaction vessel, the coal/solvent slurry is combined with molecular hydrogen which is introduced through line 18. Generally, hydrogen will be added in an amount within the range from about 2 to about 8 wt % based on dry coal. In the preferred embodiment, the liquefaction vessel will be sized so as to provide a nominal holding time within the range from about 20 to about 60 minutes and heat will be added or removed as required to maintain a temperature in the liquefaction vessel within the range from about 800° to about 880° F. Pressure in the liquefaction vessel will be maintained at a value within the range from about 1500 to about 2000 psia with control valve 19 which is located in product withdrawal line 20.

After the products from the liquefaction vessel pass through pressure control valve 19 they are then fed through line 22 to atmospheric fractionator 23. At this point, the product stream comprises product gases, product liquids, spent solvent, dissolved coal and mineral matter. In the atmospheric fractionator 23, the product stream is separated to a more desirable distribution. Essentially any distribution could, of course, be obtained but in the embodiment illustrated, the gaseous components and the light liquid hydrocarbon products are taken overhead through line 24. A middle fraction comprzsing the spent solvent as well as liquid product boiling in the range of the spent solvent is withdrawn through line 25. A heavier liquid product is then withdrawn through line 26 and may be further separated using conventional techniques such as vacuum fractionation. The undissolved coal and the mineral matter is withdrawn through line 27. Again, the untreated coal and the mineral matter may be subjected to further treatment such as coking and/or gasification using conventional techniques.

In the preferred embodiment, the solvent fraction withdrawn through line 25 will be hydrogenated before the same is recycled to mixing vessel 10. Preferably, the hydrogenation will be accomplished catalytically at conditions known in the prior art to be effective for this purpose. In the embodiment illustrated, the hydrogenation is accomplished in hydrogenation vessel 28 with a gas comprising molecular hydrogen or a hydrogen donor introduced through line 29. The hydrogenation product is then recycled to mixing vessel 10 through line 12. In those cases where the amount of liquid withdrawn through line 25 exceeds the amount of solvent required during liquefaction, any excess may be withdrawn through line 30 prior to hydrogenation.

Normally, the hydrogenation will be accomplished at a temperature within the range from about 650° to about 850° F. and at a pressure within the range from about 650 ° to about 2000 psia. The hydrogen treat rate during the hydrogenation generally will be within the range from about 1000 to about 10,000 SCF/BBL. Any of the known hydrogenation catalysts may be employed but a nickel moly catalyst is most preferred.

Having thus broadly described the present invention and a preferred embodiment thereof, it is believed that the same will become even more apparent by reference to the following examples. It will be appreciated, however, that the examples are presented solely for purposes of illustration and should not be construed as limiting the invention.

EXAMPLE I 2600 grams of Wyodak coal (containing 20% moisture) of a size ranging from −8 mesh to 0 mesh was fluidized in an autoclave and pretreated with a dry gaseous mixture comprising sulfur dioxide and oxygen in a $O_2$:$SO_2$ molar ratio of 0.57 for a period of 30 minutes at 2 psig and at a gas velocity of 0.3 ft/sec. The total gas contacted with the coal was sufficient to provide 2.1 moles of $SO_2$ per mol of calcium contained in the coal and 1.2 mols of oxygen per mol of calcium contained in the coal. A slight exotherm was noted but otherwise the treatment was conducted at ambient temperatures. The coal specimen, after 30 minutes of treatment, was then removed from the autoclave, vacuum dried at 140° F. for sixteen hours and then analyzed by x-ray. These data, when compared with a raw, untreated sample, showed that calcium sulfate was present in the treated coal specimen.

It is believed that the sulfur dioxide on contact with the moisture within the pores of the coal forms sulfurous acid which, in turn, reacts with calcium to form the sulfite and/or the bisulfite which, due to the present $O_2$ oxidized rapidly to the sulfate. In any event, an insoluble, thermally stable species, or species which does not decompose at coal liquefaction conditions, is rapidly formed when $O_2$ is present.

From the elemental analyses of the raw and treated coals the amount of sulfur fixed by the coal was calculated. The fixed sulfur is nearly constant for the several runs, using as-received coal, being about 1 mol of sulfur per mol of calcium.

EXAMPLE II

In this example, a portion of the sulfur dioxide-treated coal from Example I and a raw Wyodak specimen used as a control were liquefied in batch tube autoclaves at 840° F. at 1500 psig in the presence of a hydrogenated creosote oil solvent (1.6:1 ratio of solvent:coal) with 4 wt % added molecular hydrogen based on coal. Amount of $CaCo_3$ present in the residue ash was estimated to be about 14 wt %. In an identical run, but without pretreatment, the residue ash contained about 53 wt % calcium carbonate. The amount of $CaCo_3$ present in the liquefaction residue ash is a measure of the effectiveness of the $SO_2$ pretreatment. The lower the number, the better the pretreatment effectiveness.

EXAMPLE III

In this Example, the runs of Examples I and II were repeated except that the gas used to effect pretreatment was saturated with moisture at the temperature of the pretreatment. The liquefaction residue ash contained only 8 wt % calcium carbonate.

At the moisture content used in Examples I and III, the finely divided coal particles exhibited no tendency to agglomerate during liquefaction. Within the experimental scattering, as will be apparent from the foregoing, the use of a pretreat gas saturated with water results in the same, if not further reduction in the calcium carbonate concentration in the liquefaction residue.

While the present invention has been described and illustrated by reference to particular embodiments thereof, it will be appreciated by those of ordinary skill in the art that the same lends itself to variations not necessarily illustrated herein. For this reason, then, reference should be made solely to the appended claims for purposes of determining the true scope of the present invention.

Having thus described and illustrated the invention, what is claimed is:

1. A process for the liquefaction of a lower ranking coal or similar solid carbonaceous material comprising the steps of:

(a) adjusting the moisture content of said solid carbonaceous material to an amount within the range from about 10 to about 25 wt %, based on dry solid carbonaceous material;

(b) contacting said coal or carbonaceous material containing from about 10 to about 25 wt % moisture with a gaseous mixture comprising sulfur dioxide and a gaseous oxidizing agent so as to reduce the amount of alkaline earth metal humates therein;

(c) liquefying the thus treated coal at liquefaction conditions to produce a petroleum-like product; and (d) recovering the liquid product from the unliquefied portion of the pretreated coal or similar solid carbonaceous material.

2. The process of claim 1 wherein the coal or similar solid carbonaceous material is ground so that all particles are less than 1-quarter inch in diameter.

3. The process in claim 1 wherein the coal or similar solid carbonaceous material is contacted with sulfur dioxide at a total pressure within the range from about 15 to about 50 psia and a sulfur dioxide partial pressure within the range from about 0.5 to about 40 psia.

4. The process of claim 3 wherein the contacting is accomplished with a gaseous mixture comprising $SO_2$ and from about 0.25 to about 1.5 mols of $O_2$ per mol of $SO_2$.

5. The process of claim 4 wherein the nominal contacting time is within the range from about 10 to about 60 minutes.

6. The method of claim 5 wherein the liquefaction is accomplished in the presence of a hydrogen-donor solvent.

7. The method of claim 6 wherein the liquefaction is accomplished in the presence of added molecular hydrogen.

8. The method of claim 7 wherein the liquefaction is accomplished at a temperature of about 800° to about 880° F. and at a pressure within the range from about 1500 to about 2000 psig.

9. The method of claim 1 wherein the contacting is accomplished in a fluidized bed.

10. The method of claim 1 wherein the moisture content is within the range from about 20 to about 25 wt %.

11. A process for the liquefaction of lower ranking coal or similar solid carbonaceous material comprising the steps of:

(a) adjusting the moisture content of said solid carbonaceous material to an amount within the range from about 10 to about 25 weight percent, based on dry, solid carbonaceous material;

(b) contacting said coal or carbonaceous material containing from about 10 to about 25 weight percent moisture with gaseous $SO_2$ and then a gaseous oxidizing agent so as to reduce the amount of alkaline earth metal humates therein;

(c) liquefying the thus treated coal at liquefaction conditions to produce a petroleum-like product; and (d) recovering the liquid product from the unliquefied portion of the pretreated coal or similar solid carbonaceous material.

12. The process of claim 1 wherein the gaseous mixture comprising sulfur dioxide and a gaseous oxidizing agent is saturated with moisture at the temperature of the pretreatment.

13. The process of claim 10 wherein the gas used to effect pretreatment is saturated with moisture at the temperature of the pretreatment.

* * * * *